US005808539A

United States Patent [19]

White

[11] Patent Number: 5,808,539

[45] Date of Patent: Sep. 15, 1998

[54] TEMPERATURE RESPONSIVE SNAP ACTING CONTROL ASSEMBLY, DEVICE USING SUCH ASSEMBLY AND METHOD FOR MAKING

[75] Inventor: Sheldon S. White, Brookline, Mass.

[73] Assignee: Texas Instruments Incorporated, Dallas, Tex.

[21] Appl. No.: 919,990

[22] Filed: Aug. 28, 1997

[51] Int. Cl.[6] ..... H01H 37/52; H01H 37/54; H01H 37/72

[52] U.S. Cl. ..... 337/379; 337/111; 337/343; 337/102; 337/107; 337/113; 337/298

[58] Field of Search ..... 337/112, 113, 337/343, 372, 373, 342, 365, 379

[56] References Cited

U.S. PATENT DOCUMENTS

| | | | |
|---|---|---|---|
| 4,458,231 | 7/1984 | Senor | 337/107 |
| 4,476,452 | 10/1984 | D'Entremont | 337/102 |
| 5,206,622 | 4/1993 | Lattari | 337/89 |
| 5,402,099 | 3/1995 | Ballard et al. . | |
| 5,555,766 | 9/1996 | Johnson et al. . | |

*Primary Examiner*—Leo P. Picard
*Assistant Examiner*—Anatoly Vortman
*Attorney, Agent, or Firm*—Russell E. Baumann; Richard L. Donaldson; Rene' E. Grossman

[57] ABSTRACT

A snap acting thermostatic disc assembly having a thermostatic disc element (20) responsive both to current and to ambient temperature is provided with an electrical contact (22) on a face surface on the disc element at one end thereof and a weld slug (24) at an opposite end of the disc element and has a fulcrum member (28, 28', 28") on the opposite face surface of the disc element in alignment with the weld slug. The fulcrum member is arranged to move the bending location of the disc element member away from the heat affected zone of the thermostatic metal caused by welding. In a second embodiment the snap acting disc element is used as an ambient temperature responsive control member.

10 Claims, 3 Drawing Sheets

TEMPERATURE RESPONSIVE SNAP ACTING CONTROL ASSEMBLY, DEVICE USING SUCH ASSEMBLY AND METHOD FOR MAKING

This invention relates generally to snap acting elements made from thermostat metals and more particularly to such snap acting elements having enhanced cycle life.

BACKGROUND OF THE INVENTION

It is known in the art to use a dished-shaped snap acting thermostatic element such as a bimetallic disc with a so-called movable electrical contact welded to the disc as a contact assembly. Many of these contact assemblies are part of motor protector devices or the like in which the dished-shaped thermostatic bimetallic element provides actuation means for the device. The protector devices are located typically directly adjacent or inside the motor or other electrical equipment that the device is protecting to provide inherent protection which senses not only over current conditions but also over temperature conditions. Since the contact assemblies are current carrying, the amount of current flowing through the thermostatic element, providing self-heating, as well as the ambient temperature can result in a fault condition to cause the element to snap to an inverted dished-shaped configuration moving the movable contact away from a stationary contact of the device.

In one type of protector device a movable electrical contact is attached to one portion of a thermostatic disc element in a conventional manner, e.g., as by welding thereto, with another portion of the disc element attached to a first housing member of the protector device, as by welding thereto. The movable contact is adapted to move into and out of engagement with a stationary electrical contact mounted on a second housing member electrically separated from the first housing member with the first and second housing members electrically connected to respective terminals. Under normal operating conditions the contacts are in engagement with one another thereby closing an electrical circuit between the terminals but upon being heated to a predetermined temperature the snap acting disc element moves from a first dished configuration to an opposite second dished configuration thereby moving the movable contact out of engagement with the stationary contact to open the electrical circuit between the terminals. This opening of the circuit serves to prevent the apparatus being protected from being damaged due to over temperature conditions.

In attaching the thermostatic disc element to a support it is conventional to weld a member commonly called a slug to the disc element blank at the location of the disc element to be later welded to the support. The disc element blank can then be formed into the dished configuration of the disc element to impart snap acting characteristics responsive to selected temperatures. The slug then aids in allowing the disc element to be welded to the support without significantly affecting the snap acting disc element characteristics by minimizing the heat affected zone of the thermostatic metals of the disc element. The weld slug generally has a plurality of projections extending from a surface and spaced inwardly from an outer periphery so that the actual location of the fused metal will be pin-pointed requiring less energy and so that much of the heat caused by the welding operation will be absorbed by the slug to facilitate the limitation of the heat affected zone of the metal layers of the disc element and minimize any changes of the temperature calibration values and other characteristics of the disc element such as the amount of movement of the disc element and the available force generated during such movement. One type of weld slug in wide use has a post extending from the slug which is received through an aperture provided in the disc element to precisely locate the slug relative to the disc element and so that the post can then be welded to the support. In this way the effects of the energy used in welding the post to the support on the heat affected zone of the disc member can be minimized.

This arrangement also allows the provision of clearance between the thermostatic disc element and the support to avoid transfer of any forces from the support so that it is possible to provide a fully characterized disc assembly wherein the desired characteristics of the assembly can be formed therein prior to installation in a device and then the disc assembly can be placed in any one of various devices resulting in consistent, predictable disc element characteristics from one device to another. Without this clearance between the disc assembly and the support the disc element characteristics are dependent upon the device in which the disc assembly is received as well as the installation procedure employed. This results in varying characteristics from one device to another and the need for additional efforts in sorting of devices requiring reworking and loss in yield.

Disc assemblies which can be characterized in terms of how the disc element will behave independently of the device in which the assemblies are ultimately mounted represent a significant advantage; however, there has been a problem associated with such assemblies.

A typical disc assembly comprises an electrical contact and a slug welded to a disc element on the high expansion side of the element. The useful life of this assembly is limited generally by the development and propagation of cracks in the thermostatic disc element. These cracks initiate in the heat affected zones of the disc element proximate to the location of attachment to the housing member. As the disc element continues to cycle on and off the cracks develop and propagate and eventually affect the temperature at which the disc element changes from one configuration to the opposite configuration taking the disc element out of the useful calibration range. When this occurs the device no longer provides the desired protection and must be replaced.

SUMMARY OF THE INVENTION

An object of the present invention is to provide an improved fully characterized snap acting thermostatic disc assembly of the type described having enhanced cycle life. Another object is the provision of a method for increasing the useful life of a snap acting thermostatic disc element adapted for cantilever mounting to a support structure. Yet another object of the invention is the provision of an electrical equipment protector having an improved thermostatic disc assembly which is reliable in operation and economical to produce.

Briefly, a thermostatic disc assembly made in accordance with the invention comprises a thermostatic snap acting disc element movable between a first concave curved configuration and a reversed second convex curved configuration in dependence upon the temperature of the disc element having a plate portion of a weld slug welded to a first face surface of the disc element and a fulcrum member on the opposite, second face surface of the disc element. The fulcrum member has an edge engaging the second face surface spaced from the weld zone in a direction toward the second distal end to serve as a fulcrum to cause bending of the disc element upon reversing curvature at a location spaced from the weld zone. According to a first embodiment, an electrical contact is mounted to the disc element at the second distal end with the disc element serving as a current carrying member for use as a control element in a protector device responsive to over current conditions in a circuit serially connected to the disc element. According to another embodiment the disc element is used as a control element responsive to ambient temperature to transfer motion to a movable contact arm to open or close an electric circuit.

Other objects and features of the invention will become more readily understood from the following detailed description and appended claims, when read in conjunction with the accompanying drawings in which like reference numerals designate like parts throughout the figures thereof. Certain dimensions may have been modified for purposes of illustration.

DETAILED DESCRIPTION OF THE DRAWINGS

Figure 1:
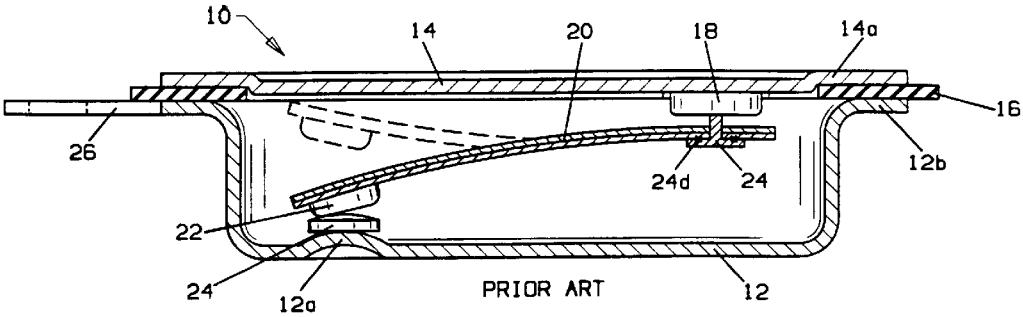
PRIOR ART FIG. 1
FIG. 1 is a cross sectional view of a prior art heat responsive device for use in the protection of electrical equipment from over current and over temperature conditions.

Referring now to the drawings, FIG. 1 shows a protector 10 made in accordance with the prior art comprising an electrically conductive metallic cup-shaped housing 12, an electrically conductive metallic cover 14 received on housing 12 and electrically separated therefrom by a window-shaped electrically insulative gasket 16. A snap acting thermostatic disc element 20 is received within housing 12 with one end of the disc element attached to cover 14 in electrical conductive relation through a stand off or spacing member 18. Stand off member 18 is used to provide space for disc element 20 to move to an opposite curved configuration shown in dashed lines and as described below. An opposite end of disc element 20 mounts a movable electrical contact 22 adapted to move into and out of engagement with a stationary electrical contact 24 fixed to detent 12*a* in the bottom wall of housing 12. Housing 12 is formed with a terminal portion 26 extending outwardly therefrom and cover 14 is formed with a similar terminal portion (not shown) for connection to a suitable electric circuit. Housing 12 is also formed with an outwardly extending flange 12*b* around its periphery for mating with the outer peripheral portion 14*a* of cover 14. Gasket 16 of mylar or other suitable electrically insulative material can be used to attach cover 14 to housing 12 as well as to electrically separate the two parts by providing a layer of suitable thermosetting material on each face side of the gasket. After the parts have been assembled pressure is applied between portions 12*b* and 14*a* and the assembly is heated to a temperature sufficient to cure the thermosetting adhesive, but not high enough to deleteriously affect the calibration of disc element 20, thereby bonding the cover to the housing.

Disc element 20 is made from a thin, composite strip made up of two or more metal layers having different thermal coefficients of expansion, so that a change in temperature will cause unequal expansion or contraction of the several layers of the strip. The strip is shaped to have a cupped portion, as for example by forming a spherical projection into a face thereof. Due to this cupped shaped configuration when the temperature of the strip is raised, the unequal expansion of the metals constituting the strip will tend to flatten the cupped surface configuration until, at a predetermined temperature, a sudden reversal or flexure of the shape of the strip occurs in the opposite direction. This reversal of shape or flexure will be maintained until the temperature is substantially lowered, at which time, the disc element 20 will suddenly return to its initial shape. In both of these movements, the reversal of curvature is exceedingly abrupt, and is caused by the differential expansion or contraction of the metal layers of which the disc element is composed.

To calibrate the switch and insure that it will function within the desired operating range, indent 12*a* is forced upwardly by applying pressure to the bottom of the can 12 until the contract 24 engages contact 22. Additional pressure is then applied to place a selected upward force on disc element 20.

In the above embodiment, contact 22 remains in engagement with contact 24 as the temperature rises until reversal or curvature occurs in disc element 20. At that time, contact 22 disengages contact 24 and opens the circuit to the apparatus being protected.

Figure 1A:
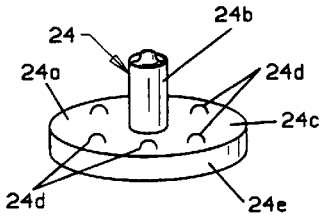
PRIOR ART FIG. 1a
FIG. 1*a* is a perspective view of a weld slug used in the FIG. 1 device.
Figure 2:
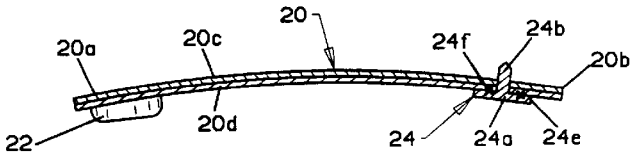
PRIOR ART FIG. 2
FIG. 2 is a front cross sectional view of the FIG. 1 thermostatic disc assembly shown with the disc element in its normal downwardly concave dished configuration.
Figure 3:
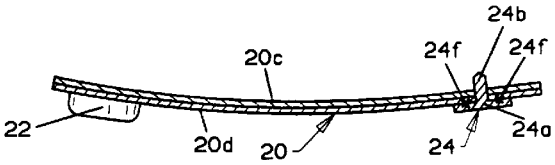
PRIOR ART FIG. 3
FIG. 3 is similar to FIG. 2 but shown with the disc element in its actuated downwardly convex dished configuration.

As mentioned above, conventionally a snap acting disc element, such as bimetallic disc element 20, is movable from a first curved configuration as shown in FIGS. 1 and 2, i.e., downwardly concave, to a second oppositely curved configuration as shown in dashed lines in FIG. 1 and in solid lines in FIG. 3, i.e., downwardly convex, in dependence upon the temperature of the disc element. That is, at temperatures below a first predetermined temperature the disc element will normally be in the FIG. 2 configuration and upon being heated to the first predetermined temperature the disc element will snap to the FIG. 3 configuration. One use for such a disc element is to serve as a current carrying member adapted to monitor the current level of a circuit and to open the circuit upon the occurrence of an overcurrent sufficient to heat disc element 20 to the first predetermined temperature. Following the opening of the circuit when the disc element cools to a second predetermined temperature, or reset temperature, lower than the first predetermined temperature, the disc element will snap back to the first configuration. For this purpose, disc element 20 is provided with a movable electrical contact 22 affixed to the free distal end 20*a* of disc 20 as by welding thereto. The opposite distal end 20*b* is fixed to and electrically connected to a housing member, such as cover 14 by means of welding slug 24. As seen in FIG. 1*a*, slug 24 typically is a small cylindrical plate 24*a* having a post 24*b* extending upwardly from the top surface 24*c* of the plate and is usually provided with a plurality of spaced weld projections 24*d* on surface 24*c* spaced inwardly from the outer periphery 24*e* of the plate to minimize the heat affected zone of the bimetal disc element incident to the welding operation. Disc element 20 is provided with a post receiving aperture and the post is then connected to cover 14 as by welding thereto to form an electrical path from the electrical contact 22 through disc element 20, welding slug 24 to cover 14.

Figure 3A:
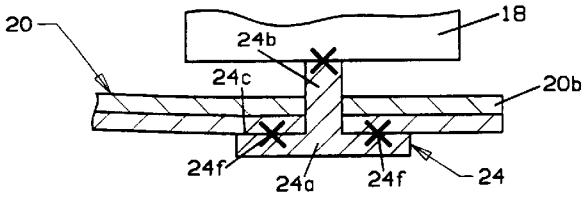
PRIOR ART FIG. 3a
FIG. 3*a* is a broken away, enlarged cross sectional view of the weld slug portion of the FIGS. 2, 3 disc assembly shown in the FIG. 3 configuration.

With reference to FIG. 3*a*, with end 20*b* of disc element 20 attached to cover 14 through weld slug 14, when the disc element reverses curvature from the FIG. 2 configuration to the FIG. 3 configuration the disc element bends away from the welds 24*f* creating a stress in the welds as well as in portions of the disc element that were affected by the heat caused by the welding operation. This heat affected zone extends into the disc element some distance from the actual welds, generally inboard of the outer perimeter of surface 24*b*. Over time, after many cycles, these stresses cause cracks in the already weakened heat affected zone of the disc element. These cracks develop and propagate and eventually change the calibration values of the disc element relative to the temperature at which the disc element snaps from one configuration to the other until it finally falls outside an acceptable temperature range.

Figure 4:
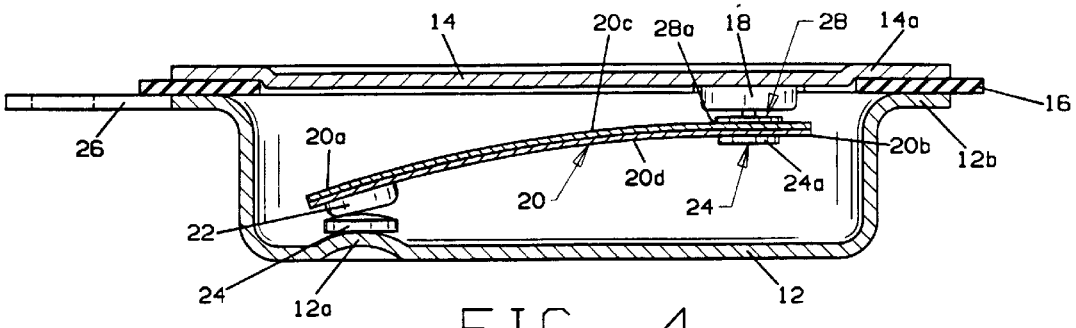
FIG. 4 is a cross sectional view similar to FIG. 1 of a protector device made in accordance with a first embodiment of the invention.
Figure 4A:
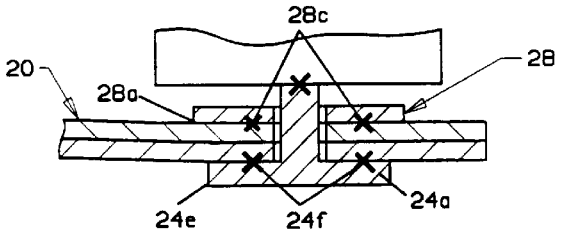
FIG. 4*a* is a broken away, enlarged cross sectional view, similar to FIG. 3*a*, of the weld slug portion of the FIG. 4 disc assembly.
Figure 4B:
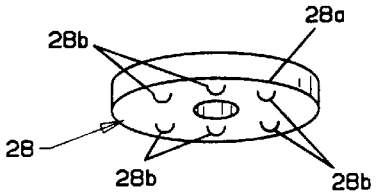
FIG. 4*b* is a perspective view of a fulcrum member useful in the FIG. 4 disc assembly.
Figure 5:
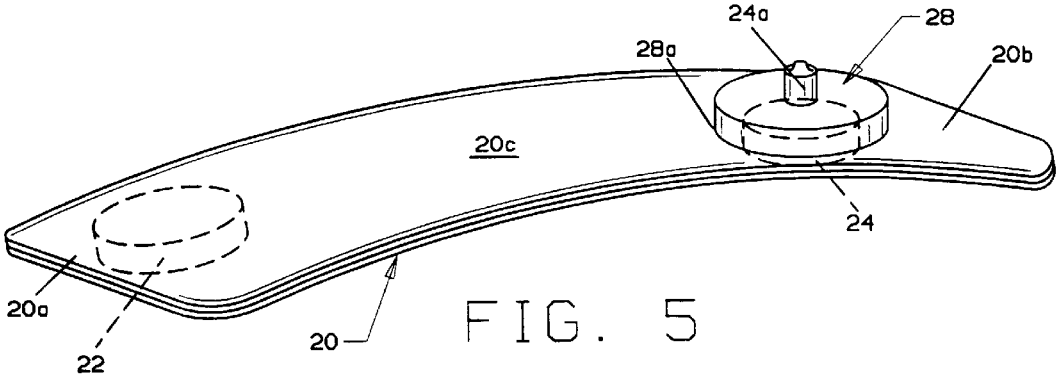
FIG. 5 is a perspective view of a snap acting thermostatic disc assembly used in the FIG. 4 device.

In accordance with the invention and with reference to FIGS. 4–5, a metal fulcrum member 28 in the form of a washer is attached to face side 20*c* of disc element 20 opposite to face 20*d* against which plate 24*a* is disposed. Fulcrum member 28 may, if desired, be formed with a plurality of spaced apart weld projections 28*b* located radially inwardly of the outer perimeter 28*a*. The outer diameter of fulcrum element 28 is chosen to be sufficiently large that perimeter 28*a* will extend beyond any heat affected zone of disc element 20 caused by welding of weld slug 24 to disc element 20 as well as the welding of fulcrum member 28 to the disc element at 28*c* and/or post 24*b*. Fulcrum member 28 serves to stiffen the disc element in the vicinity of the weld between the slug and disc element. The portion of the outer perimeter 28*a* which is closest to distal end 20*a* of disc element 20 then serves as a fulcrum about which the disc element bends when reversing curvature from the FIG. 2 to the FIG. 3 configuration as can best be seen in FIG. 4*a*. Moving the bending location of the disc away from the heat affected zone of disc element 20 greatly increases the number of cycles a disc element can snap between its two opposite configurations before developing any deleterious cracks.

Figure 6:
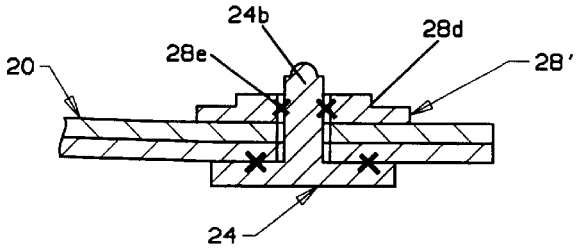
FIG. 6 is a broken away, enlarged cross section view similar to FIG. 4*a*, showing a modified fulcrum member useful in the FIG. 4 disc assembly.

In FIG. 6 a modified fulcrum member 28' is provided with a collar 28*d* to facilitate welding of the fulcrum member directly to post 24*b* of weld slug 24 as shown at 28*e* to minimize further heat input to disc element 20.

Figure 7:
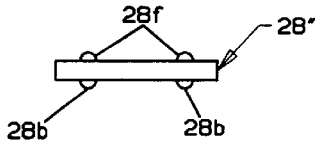
FIG. 7 is a front elevational view of another modified fulcrum member useful in disc assemblies and devices made in accordance with the invention.

In FIG. 7 another modified fulcrum member 28" is shown comprising a solid plate which, if desired, may be provided with weld projections 28*b*, 28*f*, respectively, on opposite face surfaces of the plate. Fulcrum member 28" can be used with weld slugs which do not have a post portion. In such cases the fulcrum member can be welded to a support member with the thermostatic disc element spaced from the support by the fulcrum member so that the characteristics of the disc assembly are not affected.

Figure 8:
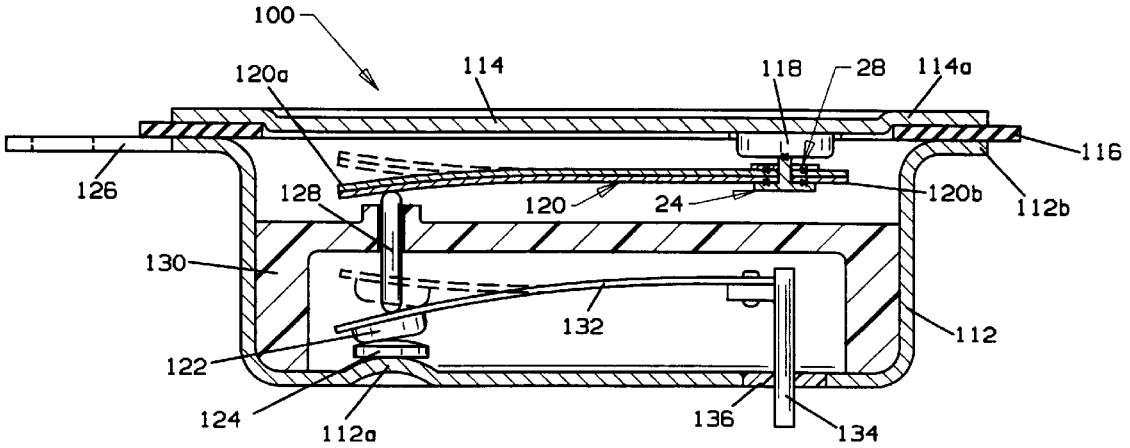
FIG. 8 is a cross sectional view of a heat responsive device made in accordance with an alternate embodiment of the invention.

Another embodiment 100 of the invention is shown in FIG. 8 in which thermostatic disc element 120 is used to respond to ambient temperature. Thermostatic disc element 120 is essentially the same as thermostatic disc element 20 shown in FIG. 4 except that it does not have an electrical contact and is therefore not arranged to conduct electrical current. When, due to an increase in ambient temperature, the temperature of thermostatic disc element 120 increases to its actuation temperature it will snap from the solid line closed circuit configuration to its opposed dished configuration shown in dashed lines in the same manner as described with reference to thermostatic disc element 20. With end 120*a* of element 120 in the dashed line configuration, movable spring arm 132 will move contact 122 out of engagement with stationary contact 124 to open the electrical circuit between terminals 126, 134. When the temperature of disc element 120 decreases to the reset temperature the disc element will snap back to the solid line position. Movement of distal free end 120*a* will be transferred through motion transfer pin 128, slidably mounted in housing portion 130, to movable arm 132 to cause movable electrical contact 122 to move into electrical engagement with stationary electrical contact 124 to close an electrical circuit between terminal 126 and terminal 134. Terminal 134, which cantilever mounts movable arm 132, is electrically separated from housing member 112 in any suitable manner, as by glass eyelet 136. Cover 114 and gasket 116 are comparable to cover 14 and gasket 16 described above. Fulcrum member 28 is attached to thermostatic disc element 120 in the same manner as the fulcrum member is attached to thermostatic disc element 20 to move the bending location of the disc element away from the heat affected zone of the thermostat metal layers and thereby increase the useful cycle life of the disc assembly.

Although the present invention has been shown and illustrated in terms of specific preferred embodiments, it will be apparent that changes and modifications are possible without departing from the spirit and scope of the invention as defined in the appended claims.

What is claimed:

1. A condition responsive device comprising a first housing member, a stationary electrical contact mounted on the first housing member, a movable electric contact mounted in the device, a snap acting thermostatic disc element having opposed first and second face surfaces, the disc element movable between a first concave curved configuration relative to a selected direction and a reversed second convex curved configuration relative to the selected directed in dependence upon the temperature of the disc element, a second housing member electrically separated from the first housing member, a weld slug having a plate portion welded to the first face surface of the disc element forming a heat affected zone of the disc element, the disc element and weld slug forming a disc assembly, the disc assembly in turn mounted to the second housing member, the movable electric contact movable into and out of engagement with the stationary electric contact with the movement of the disc element between the first and second configurations, the disc assembly including a separate metallic fulcrum member fixedly engaging the second face surface of the disc element at the heat affected zone and having an edge engaging the second face of the disc element spaced from the heat affected zone to serve as a fulcrum to cause bending of the disc element upon reversing curvature at a location spaced from the heat affected zone.

2. A condition responsive device according to claim 1 in which the movable contact is mounted on the second end of the disc element.

3. A condition responsive device according to claim 1 in which the fulcrum member is generally cylindrical.

4. A condition responsive device according to claim 1 in which the slug has a post and the disc has a post receiving aperture with the post received through the post receiving aperture of disc element.

5. A condition responsive device according to claim 1 in which the fulcrum member extends beyond the weld slug.

6. A snap acting thermostatic disc assembly comprising a snap acting thermostatic element having opposed first and second face surfaces and first and second opposed ends, the thermostatic element movable between a first concave curved configuration relative to a selected direction and a reversed second convex curved configuration relative to the selected direction in dependence upon the temperature of the thermostatic element, a weld slug having a plate portion welded to the first face surface of the thermostatic member adjacent the first end forming a heat affected zone of the thermostatic member, a separate metallic fulcrum member fixedly engaging the second face surface of the thermostatic element at the heat affected zone and having an edge engaging the second face of the thermostatic element spaced from the heat affected zone in a direction toward the second end to serve as a fulcrum to cause bending of the thermostatic member upon reversing curvature at a location spaced from the heat affected zone.

7. A snap acting thermostatic disc assembly according to claim 6 further comprising a movable contact mounted on the second distal end of the thermostatic element.

8. A snap acting thermostatic disc assembly according to claim 6 in which the fulcrum member is generally cylindrical.

9. A snap acting thermostatic disc assembly according to claim 6 in which the slug has a post and the disc element has a post receiving aperture with the post received through the post receiving aperture of the thermostatic element.

10. A snap acting thermostatic disc assembly according to claim 6 in which the fulcrum member extends in direction toward second end beyond the weld slug.

* * * * *